US011661955B2

(12) United States Patent
Huang

(10) Patent No.: US 11,661,955 B2
(45) Date of Patent: May 30, 2023

(54) FAN ENGAGEMENT STRUCTURE

(71) Applicant: ASIA VITAL COMPONENTS CO., LTD., New Taipei (TW)

(72) Inventor: Hsiao-Ping Huang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 299 days.

(21) Appl. No.: 16/801,084

(22) Filed: Feb. 25, 2020

(65) Prior Publication Data

US 2021/0262489 A1 Aug. 26, 2021

(51) Int. Cl.
*F04D 29/60* (2006.01)
*F04D 29/40* (2006.01)

(52) U.S. Cl.
CPC ..... *F04D 29/601* (2013.01); *F04D 29/403* (2013.01)

(58) Field of Classification Search
CPC ..... F04D 29/403; F04D 29/601; F04D 25/12; F04D 29/522; F04D 29/626; F04D 29/646
USPC ..... 415/213.1
See application file for complete search history.

(56) References Cited

U.S. PATENT DOCUMENTS 6,040,981 A * 3/2000 Schmitt ..... G06F 1/18 361/679.48
6,213,819 B1 * 4/2001 Fan ..... G06F 1/20 361/695
6,236,564 B1 * 5/2001 Fan ..... H05K 7/20581 312/236
6,547,540 B1 * 4/2003 Horng ..... F04D 29/646 417/423.5
6,611,427 B1 * 8/2003 Liao ..... F04D 25/166 312/236
6,690,576 B2 * 2/2004 Clements ..... H05K 7/20181 361/678
6,783,325 B1 * 8/2004 Hileman ..... F04D 29/601 415/213.1

(Continued)

FOREIGN PATENT DOCUMENTS

CN 2809713 Y 8/2006
CN 102651958 A 8/2012

(Continued)

OTHER PUBLICATIONS

Search Report dated Apr. 21, 2022 issued by China National Intellectual Property Administration for counterpart application No. 2020100827683.

(Continued)

*Primary Examiner* — Kenneth J Hansen
*Assistant Examiner* — Benjamin Doyle
(74) *Attorney, Agent, or Firm* — Demian K. Jackson; Jackson IPG PLLC

(57) ABSTRACT

A fan engagement structure for the fan to quickly and securely plug into or extract out of another structure. The fan engagement structure includes a frame main body. The frame main body has a first end and a second end. The frame main body has an internal hollow passage. The first end is mated with a fan. The frame main body has a first side and a second side. An engagement elastic plate extends from the first side. The surface of the engagement elastic plate has a latch section. The second side has a finger latch section, whereby the fan can be quickly and securely plugged into or extracted out of the other structure.

8 Claims, 7 Drawing Sheets

(56) References Cited

U.S. PATENT DOCUMENTS 6,826,048 B1 * 11/2004 Dean ..... H05K 7/20172 165/122
6,921,247 B2 * 7/2005 Stewart ..... F04D 29/601 415/214.1
7,301,768 B2 * 11/2007 Fan ..... H05K 7/20172 415/213.1
7,495,910 B2 * 2/2009 Yang ..... H05K 7/20172 361/695
7,515,413 B1 * 4/2009 Curtis ..... H05K 7/20172 415/213.1
7,746,652 B2 * 6/2010 Horng ..... H01L 23/467 174/16.3
7,758,308 B2 * 7/2010 Wu ..... G06F 1/20 415/214.1
8,379,387 B2 * 2/2013 Chuang ..... H05K 7/20172 415/213.1
8,784,167 B2 * 7/2014 Yi ..... H05K 7/20172 361/695
8,897,008 B2 * 11/2014 Terwilliger ..... F04D 29/646 361/679.48
10,485,136 B2 * 11/2019 Gopalakrishna ..... G06F 1/181
11,019,748 B2 * 5/2021 Awaru ..... H05K 7/1489
2004/0115986 A1 * 6/2004 Chen ..... F04D 29/601 439/485
2005/0024829 A1 * 2/2005 Horng ..... H05K 7/20172 361/695
2005/0036287 A2 * 2/2005 Kosugi ..... F04D 29/703 361/695
2005/0238494 A1 * 10/2005 Lien ..... F04D 29/601 416/244 R
2006/0154593 A1 * 7/2006 Lin ..... H05K 7/20727 454/184
2006/0168925 A1 * 8/2006 Whittemore ..... F24F 1/0071 55/490
2006/0268514 A1 * 11/2006 Fan ..... H05K 7/20581 361/695
2006/0279929 A1 * 12/2006 Chen ..... G06F 1/20 361/697
2007/0053159 A1 * 3/2007 Crippen ..... H05K 7/20172 361/695
2007/0064386 A1 * 3/2007 Peng ..... G06F 1/183 361/679.48
2008/0107479 A1 * 5/2008 Yang ..... H05K 7/20172 403/155
2009/0034191 A1 * 2/2009 Yin ..... H05K 7/20172 361/695
2009/0059521 A1 * 3/2009 Yin ..... F04D 25/166 361/695
2009/0246015 A1 * 10/2009 Hsu ..... F04D 19/007 415/213.1
2010/0002375 A1 * 1/2010 Yao ..... F04D 25/0613 361/679.49
2010/0078948 A1 * 4/2010 Wu ..... G11B 33/128 292/336.3
2010/0300648 A1 * 12/2010 Grantham ..... H05K 7/20745 417/423.15
2010/0329859 A1 * 12/2010 Chen ..... F04D 19/007 415/198.1
2011/0076932 A1 * 3/2011 Li ..... G06F 1/183 454/184
2012/0148397 A1 * 6/2012 Tsai ..... G06F 1/20 415/213.1
2013/0168066 A1 * 7/2013 Wang ..... H05K 7/20172 165/122
2013/0216412 A1 * 8/2013 Sun ..... F04D 29/601 417/423.15
2014/0185313 A1 * 7/2014 Hashimoto ..... F04D 25/0613 361/679.01
2015/0092342 A1 * 4/2015 Peng ..... H05K 7/20172 361/679.48
2015/0282384 A1 * 10/2015 Ho ..... F16B 2/22 24/485
2015/0351280 A1 * 12/2015 Gonzalez Inda ..... G06F 1/181 415/126
2016/0029519 A1 * 1/2016 Chen ..... H05K 7/20172 361/679.48
2016/0245307 A1 8/2016 Sauer et al.
2017/0086332 A1 * 3/2017 Jaskela ..... H05K 7/1487
2017/0114803 A1 * 4/2017 Miwa ..... H05K 7/20145
2021/0062828 A1 * 3/2021 Hong ..... F04D 19/007

FOREIGN PATENT DOCUMENTS

CN 104295515 A 1/2015
CN 211352928 Y 8/2020
TW M366813 10/2009
TW M474168 U 3/2014
TW I676883 11/2019
TW M595941 U 5/2020

OTHER PUBLICATIONS

Search Report dated Jun. 12, 2020 issued by Taiwan Intellectual Property Office for counterpart application No. 109103386.

* cited by examiner

FAN ENGAGEMENT STRUCTURE

BACKGROUND OF THE INVENTION

1. Field of the Invention

The present invention relates generally to a fan engagement structure, and more particularly to a fan engagement structure for the fan to quickly and securely plug into or extract out of another structure.

2. Description of the Related Art

The cooling fan is the most often seen heat dissipation unit with excellent heat dissipation effect. The cooling fan serves to forcedly conduct airflow into a system chassis or personal computer or electronic product to dissipate the heat. However, the cooling fan cannot be directly securely locked on the respective units. In general, latch devices are used or screws are passed through the four corners of the fan to lock and secure the fan.

Multiple series fans or parallel fans are disposed in the system chassis. The fan 24-hour continuously operates to provide heat dissipation effect for the system chassis. As a result, the fan often fails to normally work and needs to be replaced. In the case that the fan is secured to the system chassis by means of screwing, it will be more complicated and troublesome and time-consuming to replace the fan. Therefore, those who are skilled in this field have developed a series assembly 6 serially connected with the fan for a user to quickly and conveniently replace the fan. The series assembly 6 has a main body 61 and a handheld latch ring 62 disposed on the main body 61. A press member 63 is disposed on the handheld latch ring 62. A hook member 64 is riveted on one side of the main body 61 and can be pressed. One end of the hook member 64 has a hook section 641. One end of the press member 63 is connected with one end of the hook member 64 free from the hook section 641. By means of the series assembly 61, the hook section 641 of the hook member 64 is operated and pressed up and down with a finger to hook or release the fan as a quick release assembly. However, the quick release structure of the series assembly 6 is composed of multiple small metal components (press member 63 and hook member 64) and these components must be secured onto the series assembly 6 by means of riveting. Therefore, it is inconvenient to assemble the series assembly 6 and the manufacturing cost of the fan is increased.

It is therefore tried by the applicant to provide a fan engagement structure for the fan to solve the problems existing in the prior art.

SUMMARY OF THE INVENTION

It is therefore a primary object of the present invention to provide an integrated quick release structure for a series fan or a parallel fan to quickly plug into or extract out of a system chassis or cabinet to replace the fan.

To achieve the above and other objects, the fan engagement structure of the present invention is connected with a fan serially or in parallel for the fan to quickly and securely plug into or extract out of another structure. The fan engagement structure includes a frame main body.

The frame main body has a first end and a second end. The frame main body has an internal hollow passage. The first end is mated with a fan. The frame main body has a first side and a second side. An engagement elastic plate extends from the first side. The surface of the engagement elastic plate has a latch section. The second side has a finger latch section, whereby the fan can be quickly and securely plugged into or extracted out of the other structure.

By means of the integrated structure of the present invention, the manufacturing cost is greatly lowered and the fan connected with the fan engagement structure can be quickly and securely plugged into or extracted out of the other structure.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
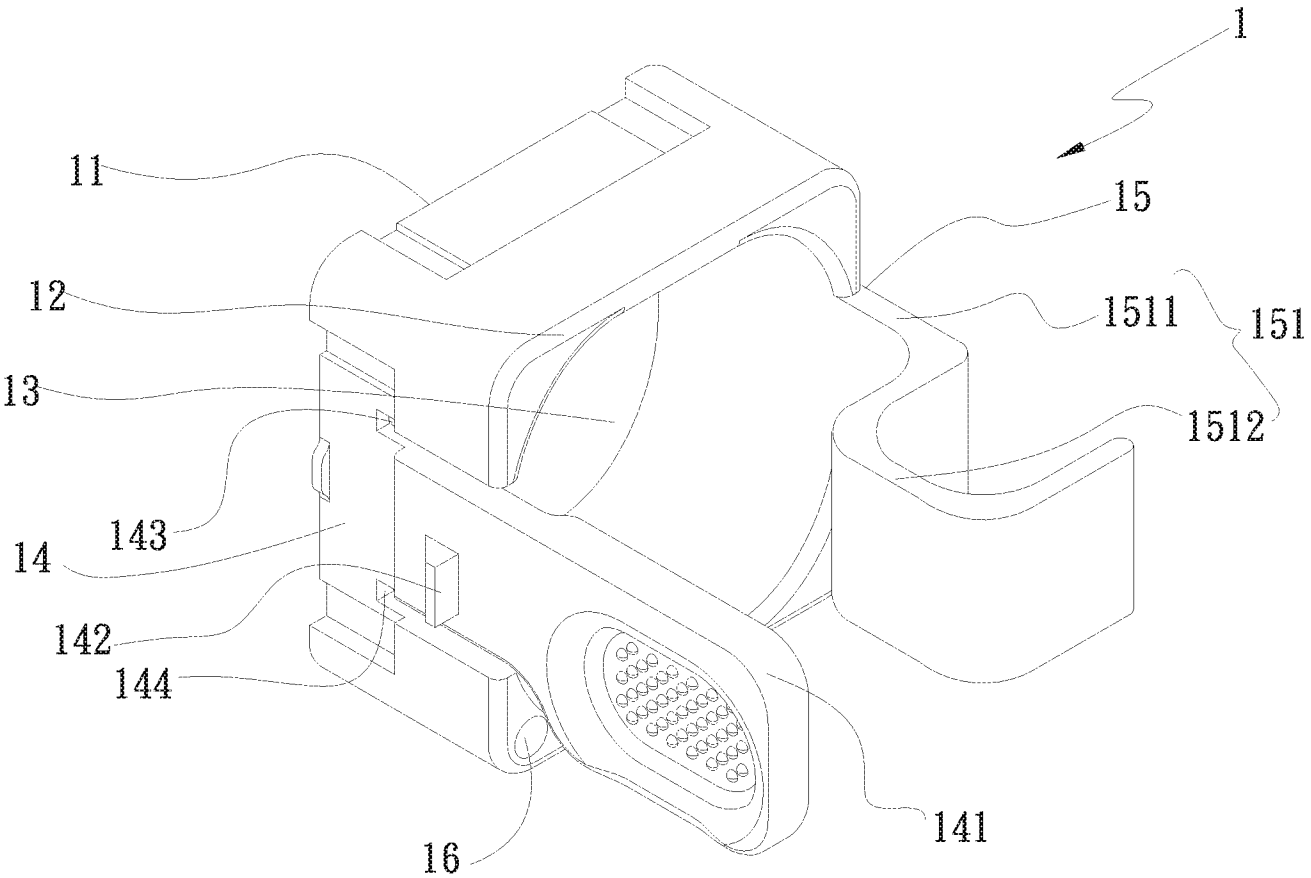
FIG. 1 is a perspective view of a first embodiment of the fan engagement structure of the present invention.
Figure 2:
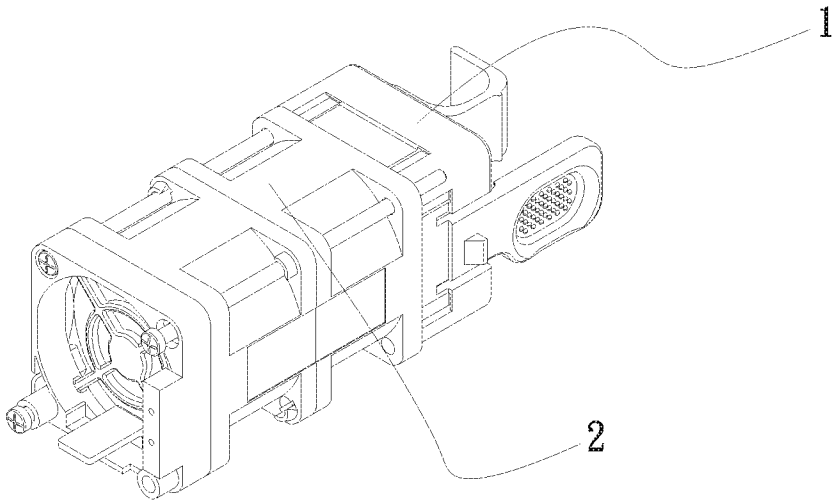
FIG. 2 is a perspective view of the first embodiment of the fan engagement structure of the present invention.

Please refer to FIGS. 1 and 2. FIG. 1 is a perspective view of a first embodiment of the fan engagement structure of the present invention. FIG. 2 is a perspective view of the first embodiment of the fan engagement structure of the present invention. The fan engagement structure of the present invention is for the fan to quickly and securely plug into or extract out of another structure. The fan engagement structure of the present invention includes a frame main body 1.

The frame main body 1 has a first end 11 and a second end 12 respectively positioned at a front end and a rear end of the frame main body 1. The frame main body 1 has an internal hollow passage 13 in communication with the first and second ends 11, 12. The first end 11 is mated with a fan 2. (In this embodiment, the fan is, but not limited to, a series fan for illustration purposes.) The outer periphery of the frame main body 1 has a first side 14 and a second side 15. An engagement elastic plate 141 extends from the first side 14. The surface of the engagement elastic plate 141 has a latch section 142 raised from the surface of the engagement elastic plate 141. The second side 15 has a finger latch section 151. Accordingly, the fan 2 can be quickly and securely plugged into or extracted out of another structure. Each of four corners of the frame main body 1 is formed with a through hole 16.

Only one end of the engagement elastic plate 141 is connected with the first side 14 of the frame main body 1. The left and right sides of the engagement elastic plate 141 respectively have a first gap 143 and a second gap 144.

The finger latch section 151 extends from the edge of the second side 15 and has a perpendicularly extending section 1511 and a U-shaped extending section 1512. The perpendicularly extending section 1511 and the U-shaped extending section 1512 are connected with each other.

Figure 3:
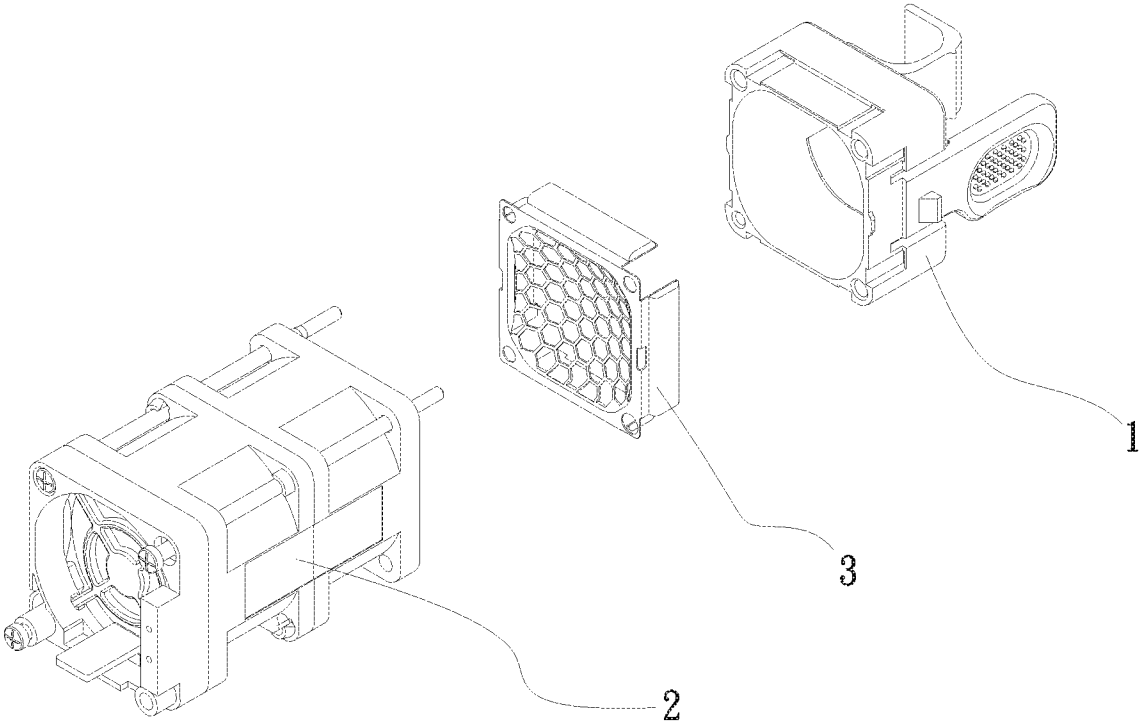
FIG. 3 is a perspective view of a second embodiment of the fan engagement structure of the present invention.

Please now refer to FIG. 3, which is a perspective view of a second embodiment of the fan engagement structure of the present invention. The second embodiment is partially identical to the first embodiment in structure and thus will not be redundantly described hereinafter. The second embodiment is different from the first embodiment in that the first end 11 is mated with the wind outlet side of the fan 2 and a mesh body 3 is disposed between the fan 2 and the first end 11.

Figure 4:
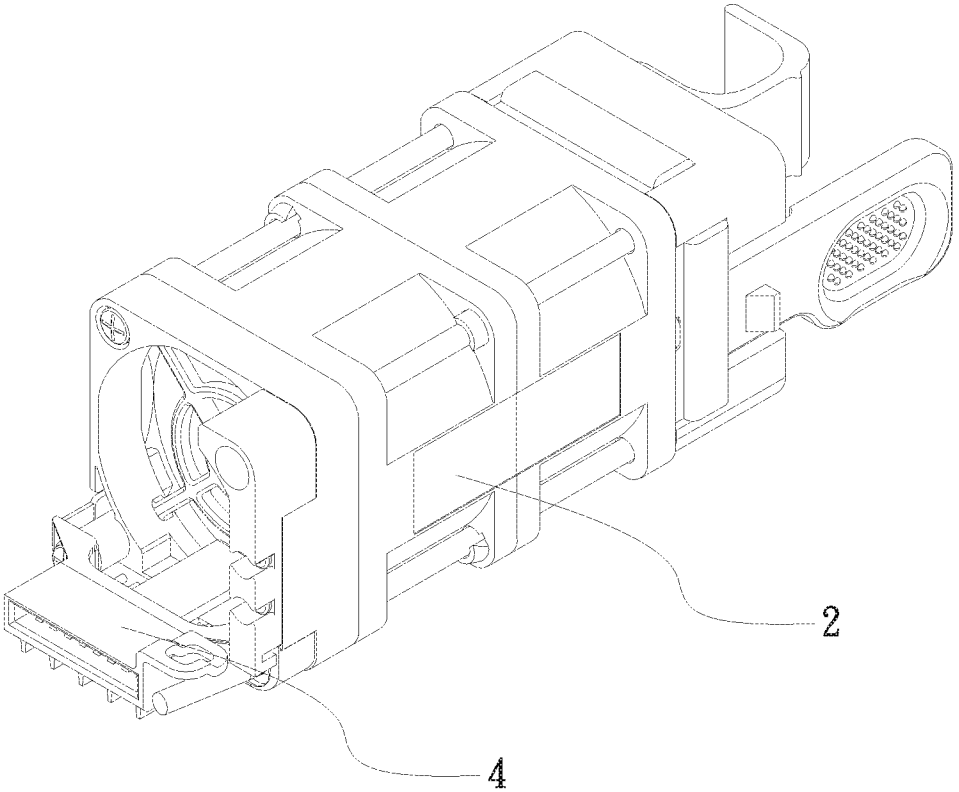
FIG. 4 is a perspective view of a third embodiment of the fan engagement structure of the present invention.

Please now refer to FIG. 4, which is a perspective view of a third embodiment of the fan engagement structure of the present invention. The third embodiment is partially identical to the first embodiment in structure and thus will not be redundantly described hereinafter. The third embodiment is different from the first embodiment in that the third embodiment further has a connection port end 4 mated with one end of the fan 2 opposite to the frame main body 1.

Figure 5:
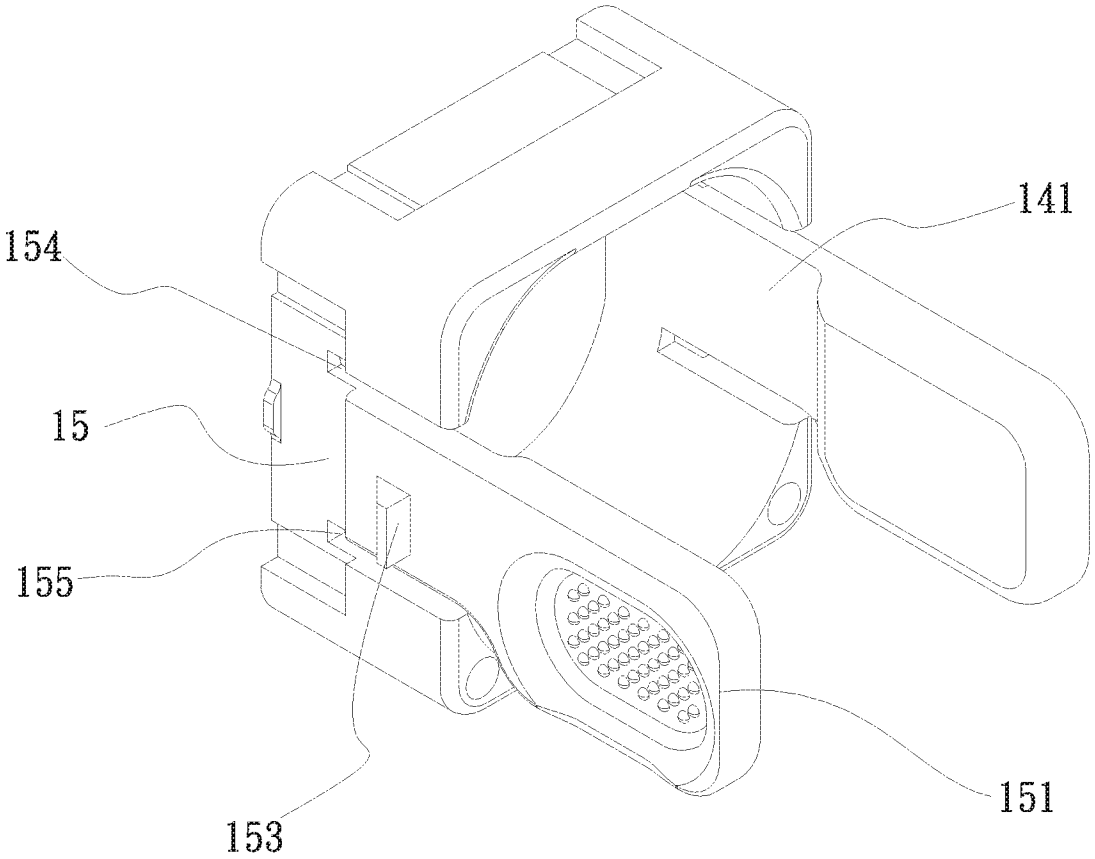
FIG. 5 is a perspective view of a fourth embodiment of the fan engagement structure of the present invention.

Please now refer to FIG. 5, which is a perspective view of a fourth embodiment of the fan engagement structure of the present invention. The fourth embodiment is partially identical to the first embodiment in structure and thus will not be redundantly described hereinafter. The fourth embodiment is different from the first embodiment in that the second side 15 also has an engagement elastic plate 152. The surface of the engagement elastic plate 152 has a latch section 153. A third gap 154 and a fourth gap 155 are formed between the left and right sides of the engagement elastic plate 152 and the second side 15.

Figure 6:
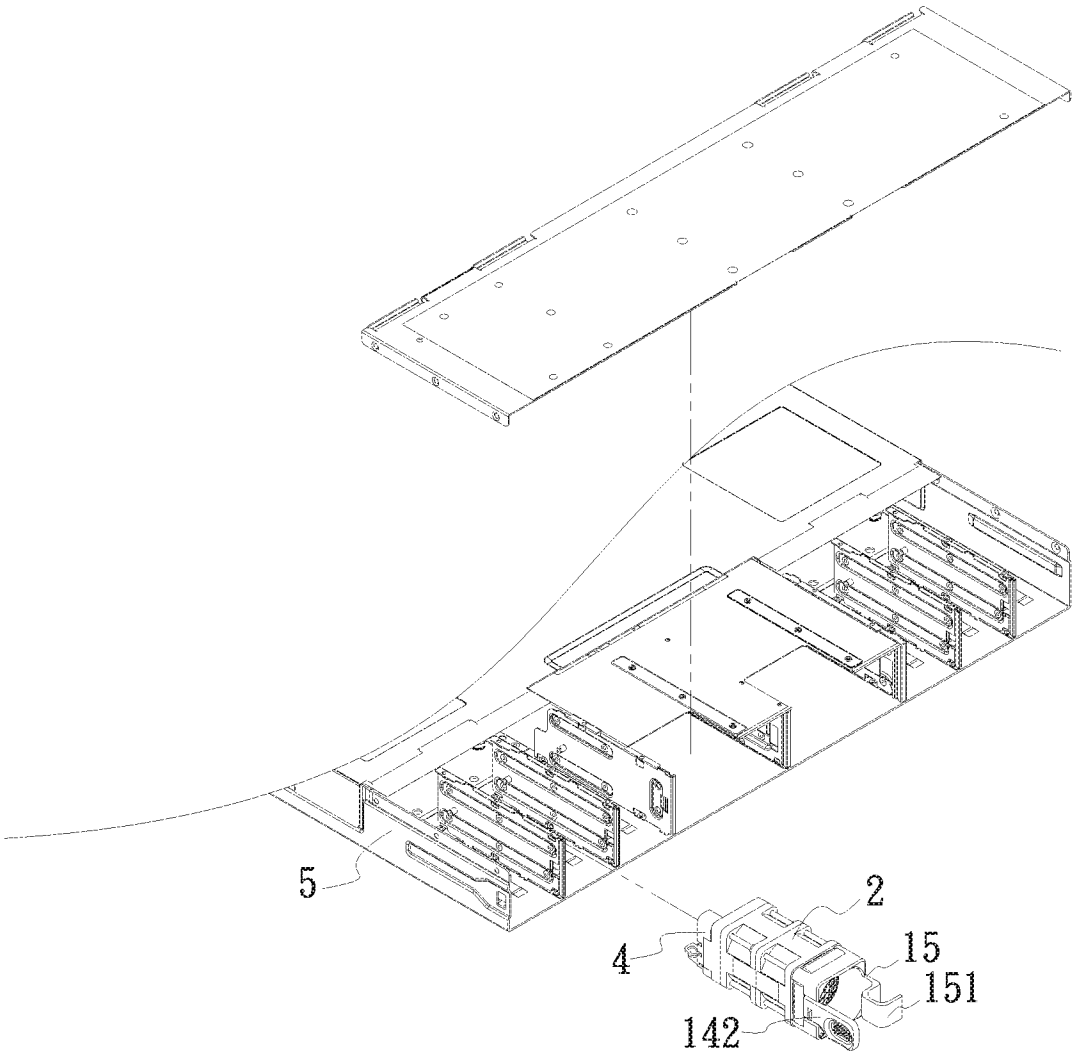
FIG. 6 is a perspective view showing the operation of the fan engagement structure of the present invention.
Figure 7:
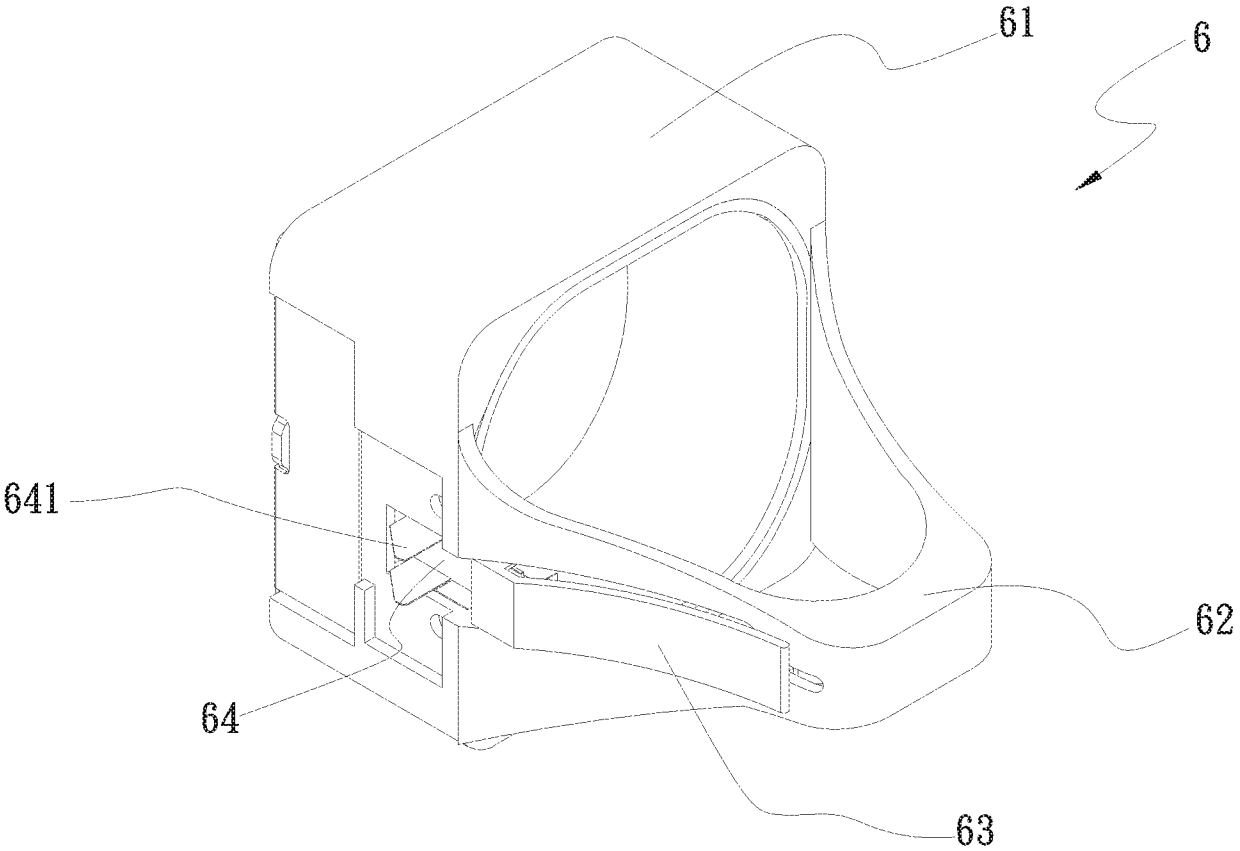
Fig. 7(PRIOR ART)
FIG. 7 is a perspective view of a conventional fan engagement structure.

Please now refer to FIG. 6, which is a perspective view showing the operation of the fan engagement structure of the present invention. As shown in the drawing, the way how the fan engagement structure is connected with the fan 2 and together secured to a server chassis 5 for quick plugging and extraction. First, one end of the fan 2 is mated with the connection port end 4. The other end of the fan 2 is mated with the frame main body 1. The connection port end 4 is plugged into a terminal (not shown) on the server chassis 5 to electrically connect therewith. The latch section 142 raised from the surface of the engagement elastic plate 141 of the frame main body 1 is securely engaged with a small dent or a small pit on a sidewall of the server chassis 5 to connect the fan 2 with the server chassis 5. When detaching the fan 2, a finger hooks the finger latch section 151 of the second side 15 of the frame main body 1 and another finger pries the movable engagement elastic plate 141. Accordingly, the latch section 142 of the surface of the engagement elastic plate 141 is separated from the small dent or small pit of the sidewall of the server chassis 5. Therefore, the fan 2 can be drawn and extracted out of the server chassis 5.

The present invention is mainly for a series fan or a parallel fan to quickly plug into or extract out of a server chassis and replaced. In addition, the components of the frame main body 1 are simplified and integrated to greatly lower the manufacturing cost.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan engagement structure for a fan to quickly and securely plug into or extract out of another structure, the fan engagement structure comprising a frame main body having a first end, an opposite second end, and an internal hollow passage, the first end configured to mate with the fan, the frame main body further having a first side, an opposite second side, and an elastic engagement plate extending from the first side, the elastic engagement plate having a free end which serves as a pressing position for a user to press, an outer surface of the elastic engagement plate having a latch section, the second side having a finger latch section, extending from an edge thereof, wherein the finger latch section has a perpendicularly extending section and a U-shaped extending section, and the perpendicularly extending section is extending outward from an edge of the second side to connect with one end of the U-shaped extending section, whereby the fan is configured to be plugged into or extracted out of the another structure by a user.

2. The fan engagement structure as claimed in claim 1, wherein only one end of the elastic engagement plate is connected with the first side of the frame main body, a left side and a right sides of the elastic engagement plate respectively having a first gap and a second gap.

3. The fan engagement structure as claimed in claim 1, further comprising a mesh body configured to mate between the fan and the first end of the frame main body.

4. The fan engagement structure as claimed in claim 1, wherein each of four corners of the frame main body is formed with a through hole.

5. The fan engagement structure as claimed in claim 1, wherein the first end of the frame main body is mated with a wind outlet side of the fan.

6. The fan engagement structure as claimed in claim 1, further comprising a connection port end mated with one end of the fan opposite to the frame main body.

7. The fan engagement structure as claimed in claim 1, wherein the latch section is raised from the surface of the elastic engagement plate.

8. The fan engagement structure as claimed in claim 1, wherein the fan is configured to be plugged into or extracted out of the another structure by a user through using only one finger.

* * * * *